United States Patent [19]

Watanabe et al.

[11] Patent Number: 4,741,306

[45] Date of Patent: May 3, 1988

[54] FUEL CUTOFF APPARATUS FOR ENGINE-DRIVEN VEHICLE

[75] Inventors: Toru Watanabe; Katuya Miyata, both of Kariya, Japan

[73] Assignee: Kabushiki Kaisha Toyoda Jidoshokki Seisakusho, Kariya, Japan

[21] Appl. No.: 859,658

[22] Filed: May 5, 1986

[30] Foreign Application Priority Data

May 10, 1985 [JP] Japan ..... 60-100328

[51] Int. Cl.[4] ..... F02B 77/08

[52] U.S. Cl. ..... 123/198 DB; 123/198 D; 123/198 DC

[58] Field of Search ..... 123/198 D, 198 DB, 198 DC

[56] References Cited

U.S. PATENT DOCUMENTS 3,533,391 10/1970 Lockmuller ..... 123/198 D
3,993,038 11/1976 Alt ..... 123/198 D
4,429,670 2/1984 Ulanet ..... 123/198 D
4,487,180 12/1984 Ito ..... 123/198 D

FOREIGN PATENT DOCUMENTS 5131332 3/1986 Japan ..... 123/198 DC

*Primary Examiner*—Ronald B. Cox
*Attorney, Agent, or Firm*—Brooks Haidt Haffner & Delahunty

[57] ABSTRACT

There is disclosed a fuel cutoff apparatus for use in an engine-driven vehicle. The apparatus comprises a fuel supply means for supplying fuel to the engine, a hydraulically actuated means that is actuated in response to the pressure of the engine oil, and a fuel cutoff control means which, when the pressure of the engine oil decreases below a certain level, is actuated in response to the actuation of the hydraulically actuated means to control the fuel supply means in such a way that the supply of fuel to the engine is cut off.

8 Claims, 1 Drawing Sheet

FUEL CUTOFF APPARATUS FOR ENGINE-DRIVEN VEHICLE

FIELD OF THE INVENTION

The present invention relates to a fuel cutoff apparatus used in an engine-driven vehicle to control the fuel supply means in such a way that the supply of fuel to the engine is cut off.

BACKGROUND OF THE INVENTION

Conventional engine-driven forklift trucks have been equipped with oil pressure switches to monitor the amount of the engine oil. When the truck is in operation, if the amount of the engine oil decreases below a certain level, the oil pressure switch is turned on. This causes a warning lamp to light up, informing the human operator of lack of the oil.

However, the operator can continue the operation even after the warning lamp has lit up. Accordingly, the operator might continue to run the vehicle while neglecting the warning. In this case, the engine may be burned out or other trouble may take place.

OBJECTS OF THE INVENTION

It is an object of the present invention to provide a fuel cutoff apparatus which is installed in an engine-driven vehicle to bring the engine to a stop when the amount of the engine oil decreases below a certain level during the operation of the vehicle, in order to prevent the occurrence of troubles such as burnout of the engine.

Other objects of the invention will become obvious upon an understanding of the illustrative embodiment about to be described or will be indicated in the appended claims, and various advantages not referred to herein will occur to one skilled in the art upon employment of the invention in practice.

DETAILED DESCRIPTION OF THE PREFERRED EMBODIMENTS

Figure 1:
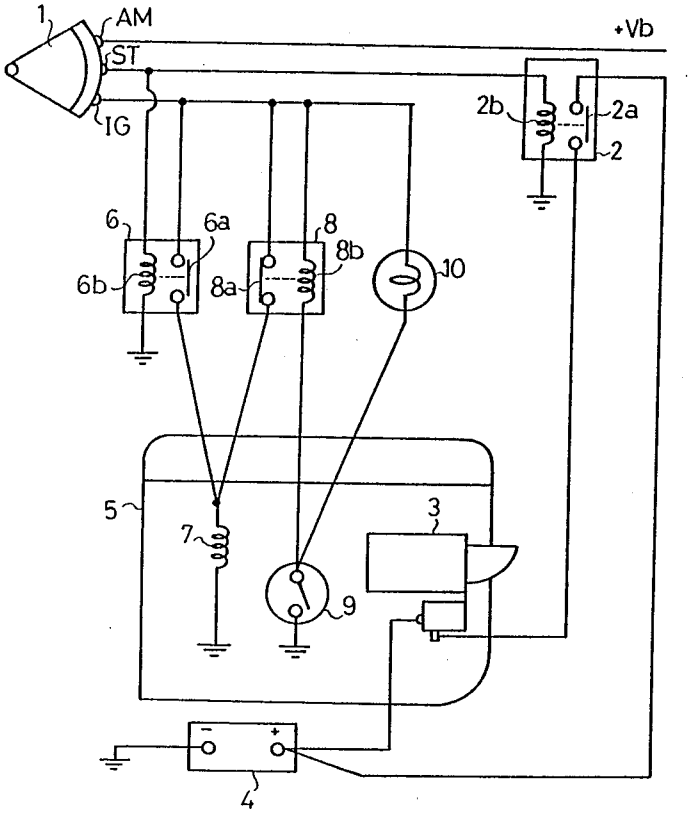
FIG. 1 is an electric circuit diagram of a fuel cutoff apparatus installed in an engine-driven vehicle, the apparatus being fabricated in accordance with the invention.

Referring to FIG. 1, there is shown a fuel cutoff apparatus embodying the concept of the invention. An ignition switch 1 has AM, ST, and IG terminals. When the engine, indicated by numeral 5, is started, all the terminals are connected with the circuitry. When the engine is in operation, the AM and IG terminals are connected with the circuitry to energize various devices (described later). At this time, the ST terminal is not connected. A starter relay 2 consists of a normally open contact 2*a* and a driver coil 2*b*. One end of the contact 2*a* is connected to the positive terminal of the battery, indicated by numeral 4. One end of the coil 2*b* is connected to the ST terminal. The other end of the contact 2*a* is tied to the starter, indicated by numeral 3. When the coil 2*b* of the relay 2 is energized, the normally open contact 2*a* is closed. Then, the starter 3 is driven from the battery 4, so that the starter 3 starts the engine 5. Another relay 6 for starting the engine acts as a means for supplying fuel to the engine upon the start of the engine. The relay 6 consists of a normally open contact 6*a* and a driver coil 6*b*, one end of the contact 6*a* being connected with the IG terminal. The coil 6*b* is connected to the ST terminal. The other end of the contact 6*a* is connected to a solenoid 7 that controls the supply of fuel. When the coil 6*b* of the engine-starting relay 6 is energized, the normally open contact 6*a* is closed, energizing the solenoid 7. Then, fuel is supplied to the engine 5. A further relay 8 for controlling the cutoff of the supply of fuel consists of a normally closed contact 8*a* and a driver coil 8*b*. One end of the contact 8*a* and one end of the coil 8*b* are connected to the IG terminal. The other end of the contact 8*a* is connected to the solenoid 7. The other end of the coil 8*b* is hooked up to an oil pressure switch 9 that is actuated in response to the hydraulic pressure of the engine oil. In particular, when the pressure is below a preset level, the switch is closed. When the pressure is in excess of the preset level, the switch is open. When the switch 9 is closed, the coil 8*b* of the relay 8 is energized to open the contact 8*a*. A warning lamp 10 is connected between the IG terminal of the ignition switch 1 and the pressure switch 9. When the switch 9 is closed, the lamp 10 is energized through the ignition switch 1 and caused to light up.

In the operation of the fuel cutoff apparatus constructed as described above, when the AM, IG, and ST terminals are excited by operating the ignition switch 1 to start the engine 5, the driver coil 2*b* of the starter relay 2 is energized. This causes the normally open contact 2*a* to close. As a result, the starter 3 starts the engine 5. At the same time, the driver coil 6*b* of the engine-starting relay 6 is energized, closing the normally open contact 6*a*. Then, fuel is supplied to the engine 5.

At the time of this start of the engine the pressure of the engine oil is below the preset value. Under this condition, the pressure switch 9 is closed. Therefore, the coil 8*b* of the relay 8 is kept energized, so the contact 8*a* is open. The pressure of the engine oil increases with the operation of the engine 5 until the preset level is reached, whereupon the pressure switch 9 is opened. Then, the normally closed contact 8*a* of the relay 8 is closed, followed by energization of the solenoid 7.

When the engine 5 shifts to its normal operation after being started by the starter 3, the ignition switch 1 automatically returns to its original state, where the IG and AM terminals are excited. The contact 2*a* of the relay 2 and the contact 6*a* of the relay 6 are then opened. Consequently, the starter 3 ceases to operate. Simultaneously, the relay 6 ceases to energize the solenoid 7, but the supply of fuel to the engine 5 is not stopped, because the contact 8*a* of the relay 8 has been already closed, resulting in energization of the solenoid 7.

When the pressure of the engine oil decreases below the preset level during the operation of the engine, the fuel cutoff apparatus operates in the manner described below. When the amount of the engine oil is reduced to such a value that the oil pressure decreases below the preset level, the pressure switch 9 is closed. The driver coil 8*b* of the relay 8 is then energized to thereby open the normally closed contact 8*a*. This deenergizes the solenoid 7, cutting off the supply of fuel to the engine 5. As a result, the engine 5 stops. The closure of the pressure switch 9 also causes the warning light 10 to light up, which informs the driver that the amount of engine oil has decreased below the preset level.

In the present example, the reduction in the amount of the engine oil is detected by the pressure switch 9, which then actuates the relay 8 to deenergize the solenoid 7. Then, the supply of fuel to the engine 5 is halted, stopping the engine 5. Since it is impossible to continue the operation of the vehicle while the engine oil is deficient in amount, burnout of the engine or other trouble can be prevented.

Also in the present example, when the engine is started, the oil pressure might be low in spite of the normal state of the engine oil. In this case, the solenoid 7 is energized via the engine-starting relay 6 until the contact 8*a* of the relay 8 is closed to open the pressure switch 9. Therefore, it is unlikely that the supply of fuel is cut off, disabling the start of the engine 5. Thus, the starting operation can be performed with certainty.

Figure 2:
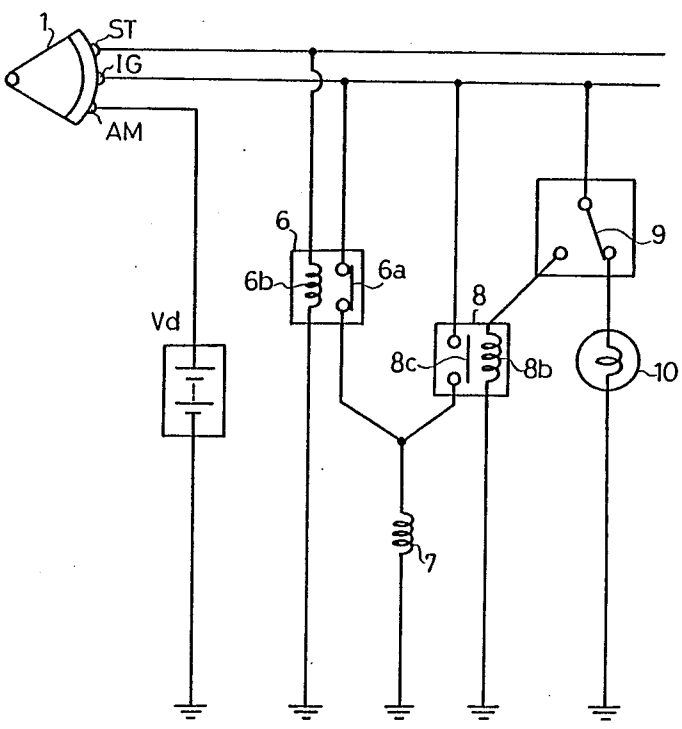
FIG. 2 is an electric circuit diagram of a modification of the fuel cutoff apparatus shown in FIG. 1.

It is to be understood that the invention is not limited to the above example. A modification of this example is shown in FIG. 2, where the pressure switch 9 has three terminals, and the normally closed contact 8*a* of the relay 8 has been replaced by a normally open contact 8*c*. When the oil pressure is below the preset level, the pressure switch 9 may be connected to the warning lamp 10. When the pressure is in excess of the preset level, the switch 9 may be connected to the driver coil 8*b* of the relay 8. In this case, the supply of fuel to the engine 5 can be cut off in the same manner as in the above example.

It is also possible to discontinue the supply of fuel to the engine 5 after the warning lamp 10 is lit for a given period to warn the driver. In this case, a timer is provided which begins to operate in response to the actuation of the pressure switch 9. The elapse of the given period is timed by the timer, which then actuates the relay 8.

As described in detail thus far, in accordance with the present invention, when the quantity of the engine oil decreases below the given level during the operation of the vehicle, the operation is stopped. Consequently, the occurrence of burnout of the engine or other trouble can be prevented.

As many apparently widely different embodiments of the invention may be made without departing from the spirit and scope thereof, it is to be understood that the invention is not limited to the specific embodiments thereof except as defined in the appended claims.

What is claimed is:

1. A fuel cutoff apparatus for use in an engine-driven vehicle, comprising an ignition switch having an off-position and an on-positon;

a fuel supply means for supplying fuel to the engine of the vehicle and comprising a fuel supply solenoid which, when energized, supplies fuel to said engine and, when deenergized, stops said supply of fuel, said solenoid being normally energized when said ignition switch is in its said on-position;

a normally-closed hydraulically actuated switch means that is actuated to an open position in response to the normal operating pressure of the engine oil in said vehicle engine, and to its closed position in response to a decrease in said engine oil pressure to a predetermined pressure which is below said normal operating prepssure;

a fuel cutoff control means comprising an electric circuit including said fuel supply solenoid, said hydrualically actuated switch means, and a fuel cutoff relay having a driver coil for operating said fuel cutoff relay, whereby, when the pressure of the engine oil decreases to said predetermined pressure while said ignition switch is in its said on-position, said hydraulically actuated switch means moves to its said closed position and said driver coil operates said fuel cutoff relay and deenergizes said fuel supply solenoid so that the supply of fuel to the engine is cut off; and a warning means actuated independently of said driver coil by said hydraulically actuated switch means moving to its said closed position, said warning means and said hydraulically actuated switch means being in series electrical connection between substantially said ignition switch on-position and ground.

2. A fuel cutoff apparatus for use in an engine-driven vehicle, comprising an ignition switch having an off-position and an on-position;

a fuel supply means for supplying fuel to the engine of the vehicle and comprising a fuel supply solenoid which, when energized, supplies fuel to said engine and, when deenergized, stops said supply of fuel, said solenoid being normally energized when said ignition switch is in its said on-position;

a normally-closed hydraulically actuated switch means that is actuated to an open position in response to the normal operating pessure of the engine oil in said vehicle engine, and to its closed position in response to a decrease in said engine oil pressure to a predetermined pressure which is below said normal operating pressure;

a fuel cutoff control means comprising an electric circuit including said fuel supply solenoid, said hydraulically actuated switch means, and a fuel cutoff relay having a driver coil for operating said fuel cutoff relay, said fuel cutoff relay being normally open and said driver coil being deenergized when said hydraulically actuated switch means is moved to its said closed position whereby, when the pressure of the engine oil decreases to said predetermined pressure while said ignition switch is in its said on-position, said hydraulically actuated switch means moves to its said closed position and said driver coil operates said fuel cutoff relay and deenergizes said fuel supply solenoid so that the supply of fuel to the engine is cut off, said fuel cutoff control means further comprising a start-up fuel supply control means which, when the engine is started, causes the fuel supply means to supply fuel to the engine irrespective of the pressure of the engine oil at the time of the start-up of the engine; and a warning means actuated independently of said driver coil by said hydraulically actuated switch means moving to its said closed position, said warning means being a warning lamp connected to said hydrualically actuated switch means, and said hydraulically actuated switch means being an oil pressure switch which has three terminals and which, when the pressure of the engine oil decreases below a preset level, deenergizes said driver coil and lights up said warning lamp.

3. A fuel cutoff apparatus for use in an engine-driven vehicle as set forth in claim 1, wherein said fuel cutoff control means further comprises a start-up fuel supply control means which, when the engine is started, causes the fuel supply means to supply fuel to the engine, irrespective of the pressure of the engine oil at the time of the start-up of the engine.

4. A fuel cutoff apparatus for use in an engine driven vehicle as set forth in claim 3, wherein said fuel supply means further comprises an engine-starting relay having a normally open switch contact and a fuel supply control solenoid which is energized when said normally open contact is closed, said relay being energized when said ignition switch of the vehicle is operated to start the engine.

5. A fuel cutoff apparatus for use in an engine-driven vehicle as set forth in claim 3, wherein said fuel supply cutoff relay is normally closed, and said driver coil is energized when said hydraulically actuated switch means is moved to its said closed position.

6. A fuel cutoff apparatus for use in an engine-driven vehicle as set forth in claim 5, wherein said hydraulically actuated switch means is an oil pressure switch which, when the pressure of the engine oil decreases below a preset level, closes to energize the driver coil.

7. A fuel cutoff apparatus for use in an engine-driven vehicle as set forth in claim 6, wherein said warning means is a warning lamp connected to said oil pressure switch.

8. A fuel cutoff apparatus for use in an engine-driven vehicle as set forth in claim 3, wherein said fuel cutoff relay is normally open, and said driver coil is deenergized when said hydraulically actuated switch means is moved to its said closed position.

* * * * *